US005546721A

United States Patent [19]

Daniells

[11] Patent Number: 5,546,721

[45] Date of Patent: Aug. 20, 1996

[54] CLEAN OUT BLOCK ASSEMBLY

[75] Inventor: Norman G. Daniells, Queensland, Australia

[73] Assignee: Boral Resources (QLD) pty Limited, Queensland, Australia

[21] Appl. No.: 339,956

[22] Filed: Nov. 15, 1994

[30] Foreign Application Priority Data

Jan. 14, 1994 [AU] Australia ..... PM3381

[51] Int. Cl.[6] ..... E04C 2/04

[52] U.S. Cl. ..... 52/606; 52/596; 52/607

[58] Field of Search ..... 52/220.2, 220.5, 52/439, 606, 607, 596

[56] References Cited

U.S. PATENT DOCUMENTS 4,051,640 10/1977 Vincens ..... 52/220.5

FOREIGN PATENT DOCUMENTS 8806991 11/1990 Australia .

*Primary Examiner*—Carl D. Friedman
*Assistant Examiner*—David J. Jersen
*Attorney, Agent, or Firm*—Dvorak and Traub

[57] ABSTRACT

A clean out block assembly for providing access to the interior of a building block which has a back wall and two side walls, and an essentially open front. The side walls have slots or shoulders. A replaceable front wall member is inserted into the front of the block, and is engaged by the slots or shoulders. A spring is used between the back wall and the front wall to hold the front wall in position.

6 Claims, 3 Drawing Sheets

CLEAN OUT BLOCK ASSEMBLY

This invention relates to open face building block assemblies.

In particular, this invention relates to a clean out block assembly for use in the construction of concrete hollow block structures, and for illustrative purposes, reference will be made to such application. It will be understood, however, that this invention may be used in other applications such as where access to a cored wall is required, such as in service ducting or such like.

The use of concrete building blocks in the building industry is well known, the most common type of block being a hollow block having two cores extending vertically through the block affording lightness and economy in manufacture and use. At least some, and usually all, of the cavities created by the cores extending through the walls may be filled with concrete and/or reinforcing as the wall is built. Usually, reinforcing bars are tied to starter bars projecting from a footing, the hollow cored concrete blocks are laid in successive courses one above the other over the reinforcing bars, and after the wall has been built, the hollow cores are filled with concrete.

It will be appreciated that where a wall is built in sections due to the height of the wall being greater than is practicable to fill with grout or concrete, successive sections may be built as described above.

During the construction process, mortar and/or other building debris may be spilt into the cavities as the blocks are being laid in successive courses, and it is customary to provide a lower course of clean out blocks which are generally E shaped or C shaped in plan view so that such debris may be removed from the open side of the clean out block when the wall has been completed. Additionally, access may be necessary to tie reinforcing bars to starter bars protruding from the footing or foundation.

It has been customary for sheeting or other material suitable for temporary form work be laid against the open faces of the clean out blocks to seal the open sides so that the concrete is prevented from flowing out of the clean out block when it is being poured in from the top to fill the required cavities. Upon setting of the concrete, the temporary form work may be conveniently removed.

In many cases, it is difficult to properly apply the temporary form work with the result that an uneven surface may be produced and/or the liquid concrete may leak from the opening in the clean out block. The process of installing the temporary form work may be tedious, time consuming and irritating and may increase the cost of construction.

The present invention aims to alleviate one or more of the above disadvantages and to provide a clean out block assembly which will be reliable and efficient in use.

With the foregoing in view, this invention in one aspect resides broadly in a clean out block assembly including:

a clean out block having a back wall integral with two opposed end walls defining an opening therebetween and a separate front wall adapted to block said opening defined between the front ends of said end walls;

blocking means on said end walls for blocking outward passage of the front wall from said clean out block when said front wall is disposed substantially parallel to said rear wall, and spacing means for spacing said front wall from said back wall and juxtaposed said blocking means.

The spacing means may be a fold down plate or arm which may be held raised while the front closure is inserted obliquely through the opening between the end walls and which falls down into an operative position when the front wall is moved to its operative position. Preferably, however, the spacing means includes resilient support means for urging the front wall towards said blocking means. The spacing means may be interposed between the front and rear walls for maintaining an operative spacing between the front and rear walls, but preferably, the resilient support means resiliently urges the front wall into engagement with the blocking means.

Preferably, the resilient support means resiliently supports the front wall against said blocking means which may be constituted by a groove or flange extending vertically across the inwardly facing sides of each respective end wall. Alternatively, the blocking means may be a peg, post or other protrusion so formed and arranged on the side walls and/or the front wall to prevent passage of the front wall through the opening between the end walls when the front wall is disposed parallel to the rear wall.

The resilient support means may be of any form which will resiliently support the front wall against the blocking means, including a resilient or compressible solid such as an elastomer or rubber in the form of a block, or a flexible container filled with a fluid which may also be compressible.

The support means may be attached to the internal face of the back wall or the front wall. Preferably, however, the support means includes spring means which is separate from the clean out block and the front wall and the assembly is suitably dimensioned to provide a resilient bias of the front wall outwardly to engage the front wall against the retaining means with a force sufficient to prevent the front wall being accidentally knocked out of position.

The spring means may be a leaf spring or shaped piece of spring steel or such like, but preferably, the resilient support means is in the form of a high compliance coil spring. For example, the support means may be in the form of a coil spring coiled in the shape of a waisted cylinder, such as a bed spring.

The front wall may include chamfered end portions adapted for engagement with the grooves or flanges, but preferably, the blocking means is constituted by a groove or inwardly protruding flange extending across the inwardly facing sides of each respective end wall. Additionally, a step or rebate is provided on each end of the front wall, the length of the front wall being such that it may be inserted into the clean out block betwixt the respective end walls at an angle skewed about a vertical axis. Preferably, the space between the end walls permits the front wall to be inserted into the clean out block beyond the blocking mens when skewed relative to the back wall.

In another aspect, this invention resides broadly in a method of preparing the core of a hollow core wall assembly for filling with a settable material and filling the hollow cores defined therein with the settable material, the method including:

providing clean out block assemblies as claimed in claim 1 and hollow core blocks;

laying the clean out block in a lower course of hollow core blocks;

laying further subsequent courses of hollow core blocks above the lower course to form a wall;

removing from the clean out blocks debris which may have entered through the hollow core above the clean out block;

inserting the spacing means against the inner face of the back wall;

inserting the front wall between the end walls and against the spacing means by inserting one end of the front wall into the space, displacing the spacing means by pressing the front wall against the spacing means until the other end of the front wall is admitted between the end walls of the clean out block, and operatively aligning the front wall substantially parallel to the back wall whereby the front wall is operatively blocked from outward passage by the blocking means and juxtaposed the back wall by the spacing means, and filling the laid blocks with concrete or other settable material.

When the core is filled with concrete or some other settable material, the pressure of the settable material against the front wall is accommodated by the engagement of the front wall with the retaining means. The spacing means may be formed integrally with the clean out block or the front wall, but preferably, the spacing means is separate therefrom, and is inserted into the space in the clean out block just prior to the insertion of the front wall.

In order that this invention may be more readily understood and put into practical effect, reference will now be made to the accompanying drawings which illustrate a preferred embodiment of the invention, and wherein.

Figure 1:
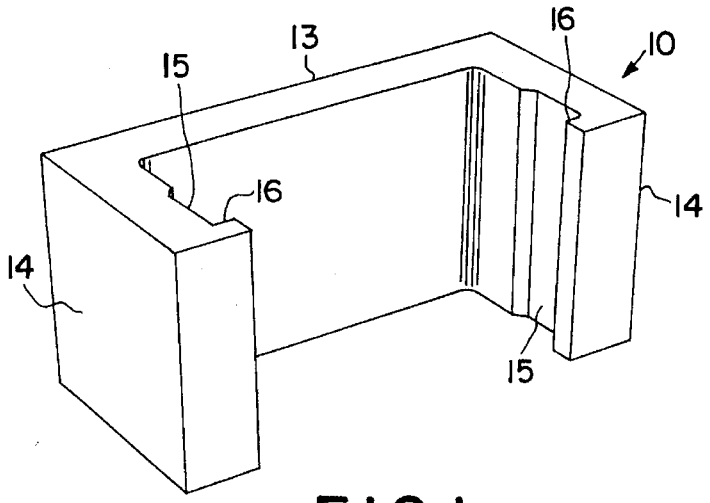
FIG. 1 is a diagrammatic view of a clean out block.
Figure 2:
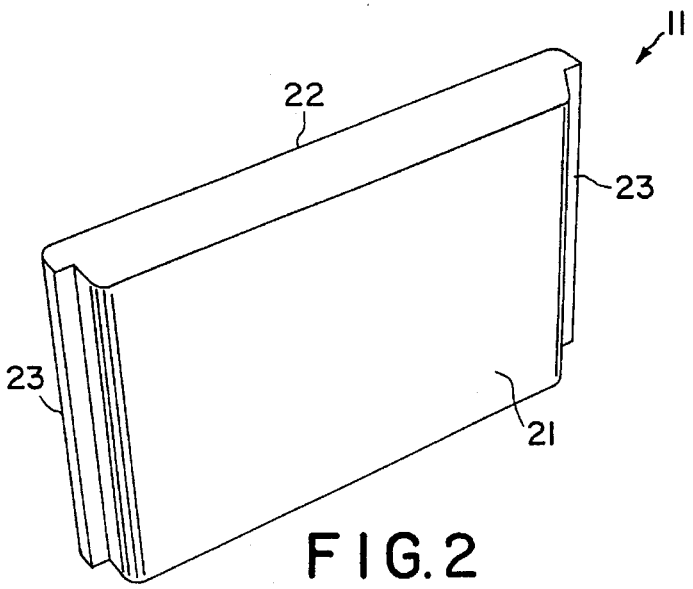
FIG. 2 is a diagrammatic view of a removable front wall.
Figure 3:
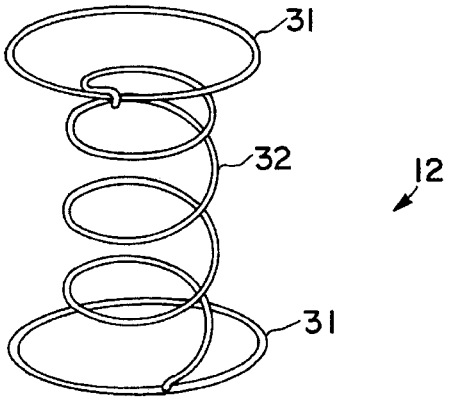
FIG. 3 is a diagrammatic view of a support spring.

Referring to FIGS. 1, 2 and 3 respectively, a clean out block assembly of the present invention includes a clean out block 10, a tile 11 and a spring 12.

The clean out block 10 includes a back wall 13 and two end walls 14. Each end wall 14 includes an inwardly facing locating groove 15 and an abutments face 16.

The tile 11 includes a front face 21, a rear face 22 and a rebate on each end of the tile 11 defining a complementary abutment face 23.

The spring 12 includes two end portions 31 for abutment against the inner face of the back wall 13 and rear face 22 of the tile 11 respectively, and a central portion 32 extending between the end portions 31 in the form of a helical coil or spiral. The central portion 32 is of a smaller diameter than the end portion whereby the spring 12 may collapse upon itself to provide a relatively large amount of compression.

Figure 4:
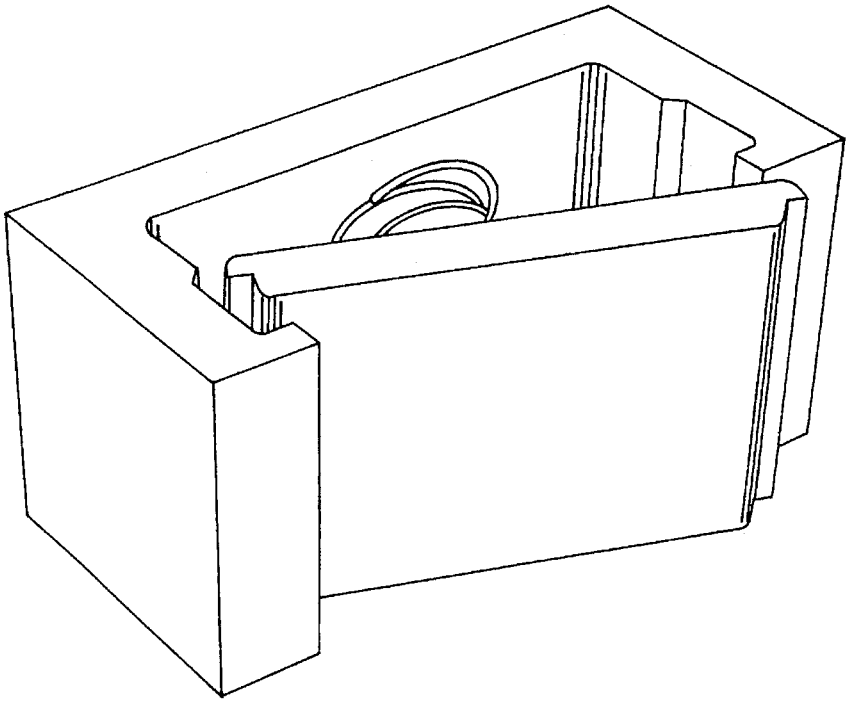
FIG. 4 is a diagrammatic view of the clean out block, front wall and support spring of FIGS. 1, 2 and 3 in a partly assembled attitude.

Referring to FIG. 4, a tile 11 is partially inserted into its operative position in the clean out block 10 by inserting the tile 11 through the opening between the respective end walls 14. The spring 12 presents a biassing force between the tile 11 and the clean out block 10 pushing the tile 11 outwardly from the clean out block 10.

Figure 5:
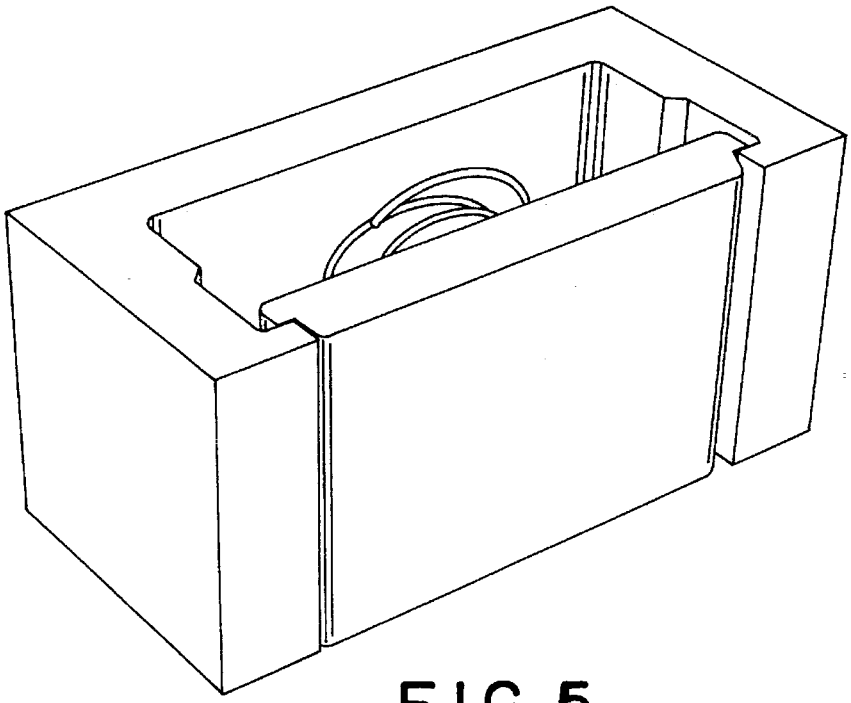
FIG. 5 is a diagrammatic view of the clean out block, front wall and support spring in an assembled attitude.

Once the tile 11 is in position within the opening in the clean out block 10, the spring 12 pushes the tile 11 against the abutment face 16 by engagement of the complementary abutment faces 23 on the tile 11 with the abutment face 16 on the clean out block 10 as shown in FIG. 5.

Figure 6:
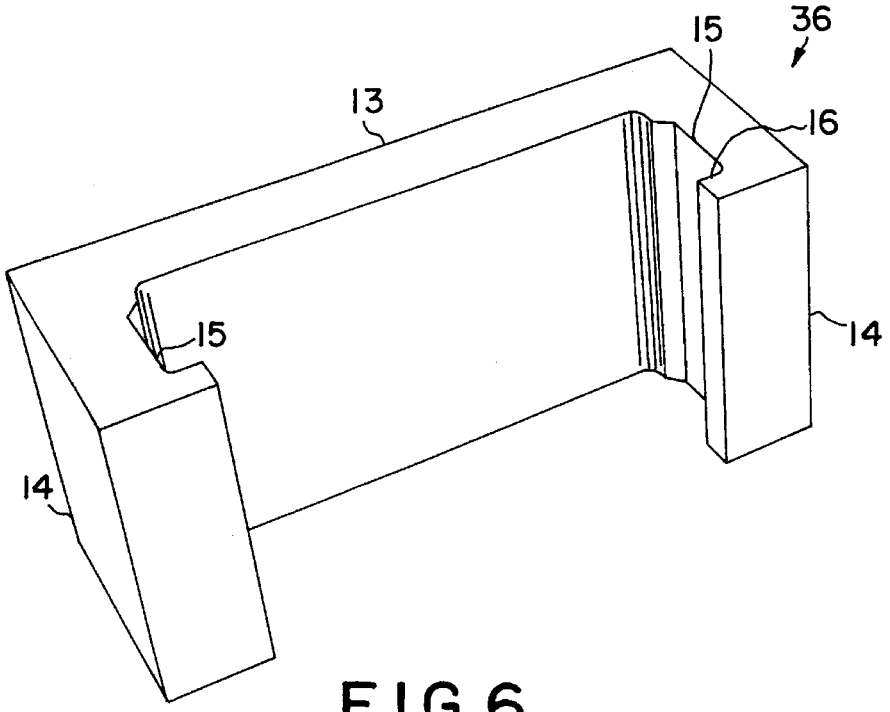
FIGS. 6 and 7 are diagrammatic views of alternative embodiments of the clean out block of FIG. 1.
Figure 7:
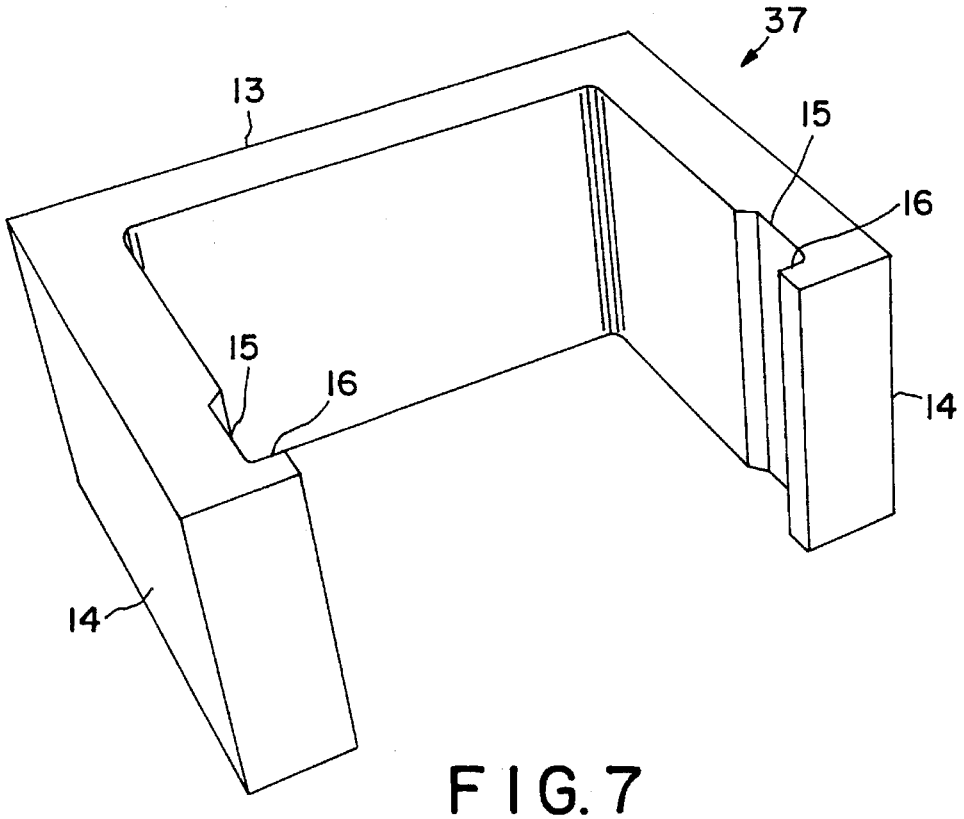

Referring to FIGS. 6 and 7 respectively, a narrow wall clean out block 36 and a clean out stretcher 37 are shown wherein the parts of each are numbered with same reference numerals as those used in FIG. 1.

In use, a clean out block 10 of the present invention may be used for the lowest course of bricks in a block wall construction such as a building, retaining wall or such like. The clean out blocks are placed on the first course of the brick work with the opening facing away from the side of the wall to be viewed. Successive courses of bricks are laid upon the first and subsequent courses, usually in a running bond with mortar in between each block on each course and between successive courses to separate the blocks from one another.

Any mortar or other debris which may have fallen into the cavity may be cleaned out of the opening between the end walls by scraping, washing or such like after or during construction of the wall.

In order to provide a relatively clean face and seal the cavity for filling with concrete, the clean out block is closed by first placing the spring 12 inside the clean out block with one end portion against the inside face of the back wall 13. The tile 11 is then inserted into the space between the end walls 14 in a skewed attitude so that it fits between the abutment faces 16 of the clean out block 10 and against the resilient compression of the spring 12.

The tile 11 is then aligned with the abutment faces 16 and the spring 12 pushes the tile 11 against the abutment faces 16 as shown substantially in FIG. 5.

The cavity in the wall about the course containing the clean out blocks may then be filled with concrete or some other settable material to create a substantially monolithic wall structure.

Where a wall is to be built in sections above one another, a first layer of clean out blocks may be used in the manner described above, and the subsequent courses laid and the cavities grouted.

It will of course be realized that the above has been given only by way of illustrative example of the invention and that all such modifications and variations thereto as would be apparent to persons skilled in the art are deemed to fall within the broad scope and ambit of the invention as is claimed in the following claims.

I claim:

1. A clean out block assembly comprising:

a clean out block having a back wall integral with two opposed end walls defining an opening therebetween and a separate front wall adapted to block said opening defined between the front ends of said end walls;

blocking means on said end walls for blocking outward passage of the front wall from said clean out block when said front wall is disposed substantially parallel to said rear wall; and spacing means for spacing said front wall from said back wall and juxtaposed to said blocking means wherein said spacing means includes resilient support means for urging said front wall towards said blocking means.

2. A clean out block assembly as claimed in claim 1, wherein said resilient support means resiliently urges said front wall into engagement with said blocking means.

3. A clean out block assembly as claimed in claim 2, wherein said resilient support means is in the form of a high compliance coil spring.

4. A clean out block assembly as claimed in claim 1, wherein said blocking means is constituted by a groove or inwardly protruding flange extending across the inwardly facing sides of each respective end wall.

5. A clean out block assembly as claimed in claim 1, wherein the space between said end walls permits said front wall to be inserted into said clean out block beyond said blocking mens when skewed relative to said back wall.

6. A method of preparing the core of a hollow core wall assembly for filling with a settable material and filling the hollow cores defined therein with the settable material, said method including:

providing clean out block assemblies as claimed in claim 1 and hollow core blocks;

laying said clean out block in a lower course of hollow core blocks;

laying further subsequent courses of hollow core blocks above said lower course to form a wall;

removing from said clean out blocks debris which may have entered through the hollow core above said clean out block;

inserting said spacing means against the inner face of said back wall;

inserting said front wall between said end walls and against said spacing means by inserting one end of said front wall into said space, displacing said spacing means by pressing said front wall against said spacing means until the other end of said front wall is admitted between said end walls of said clean out block, and operatively aligning said front wall substantially parallel to said back wall whereby said front wall is operatively blocked from outward passage by said blocking means and juxtaposed said back wall by said spacing means, and filling the laid blocks with concrete or other settable material.

* * * * *